US005180084A

United States Patent [19]

Favre

[11] Patent Number: 5,180,084

[45] Date of Patent: Jan. 19, 1993

[54] APPARATUS FOR DISPENSING COSMETICS

[75] Inventor: Bernard Favre, Chevilly Larue, France

[73] Assignee: Lir France, Chevilly Larue, France

[21] Appl. No.: 700,701

[22] Filed: May 15, 1991

[30] Foreign Application Priority Data

May 15, 1990 [FR] France ..... 90 06019

[51] Int. Cl.[5] ..... B67D 5/06

[52] U.S. Cl. ..... 222/192; 222/205; 132/317

[58] Field of Search ..... 222/182, 192, 205, 378; 132/313, 314, 315, 317, 318; 401/125

[56] References Cited

U.S. PATENT DOCUMENTS

| | | | |
|---|---|---|---|
| 2,552,714 | 5/1951 | Gardiner | 132/318 X |
| 2,619,096 | 11/1952 | Kuhnl | 132/315 |
| 3,263,871 | 8/1966 | Thompson | 222/205 |
| 3,469,746 | 9/1969 | Melocchi | 222/182 |
| 4,223,804 | 9/1980 | Morris et al. | 222/192 X |
| 4,605,022 | 8/1986 | Gueret | 132/314 |
| 4,657,161 | 4/1987 | Endo et al. | 222/256 |
| 4,685,594 | 8/1987 | Czech | 222/182 |
| 4,757,922 | 7/1988 | Landecker | 222/205 |
| 4,865,228 | 9/1989 | Landecker | 222/205 X |

FOREIGN PATENT DOCUMENTS

| | | |
|---|---|---|
| 322178 | 6/1989 | European Pat. Off. . |
| 3738792 | 4/1989 | Fed. Rep. of Germany . |
| 909983 | 5/1946 | France . |
| 985395 | 7/1951 | France . |
| 2637871 | 4/1990 | France . |

*Primary Examiner*—Andres Kashnikow
*Assistant Examiner*—Kenneth Bomberg
*Attorney, Agent, or Firm*—Helfgott & Karas

[57] ABSTRACT

An apparatus for dispensing cosmetic products includes a container, a flip-top cap pivotable on the top of the container between a closed and open position, a pump actuated after opening of the cap, a plunger contained in the container and biased by a spring, and an applicator brush. A push-button is provided which forms with the cap a locking arrangement for the cap. The cap when pivoted to the closed position, causes the plunger to descend into the container.

8 Claims, 3 Drawing Sheets

APPARATUS FOR DISPENSING COSMETICS

BACKGROUND OF THE INVENTION

The present invention relates to an apparatus for dispensing products and, more particularly, to an apparatus for dispensing cosmetics, which can readily be kept in a handbag.

These dispensing apparatuses are generally equipped with a flip-top cap and they contain a product reservoir, a pump and an applicator brush.

The document FR 985,395 discloses such an apparatus, the cap of which is unlocked by a control button, the product then being applied to the brush with the aid of another control button.

SUMMARY OF THE INVENTION

The object of the present invention is to simplify the use of this apparatus by providing a single push-button to unlock the cap and actuate the pump.

A further object of the present invention is to ensure easy access to the applicator brush by providing mechanical means which ensure a partial ejection of the brush after opening of the cap.

The subject of the present invention is an apparatus for dispensing products, comprising a body, a flip-top cap and a control button for opening this cap, the body containing a sealed reservoir, a pump and an applicator brush which is released after opening of the cap.

According to the invention, the control button is a push-button which unlocks the cap at the start of its stroke and which actuates the pump over its entire stroke.

According to an advantageous feature of the invention, this apparatus comprises mechanical means which ensure the flipping-over of the cap and the partial ejection of the applicator brush from the apparatus.

A dispensing apparatus according to the invention is described below by way of example and with reference to the accompanying drawings.

DETAILED DESCRIPTION OF THE PREFERRED EMBODIMENT

Figure 1:
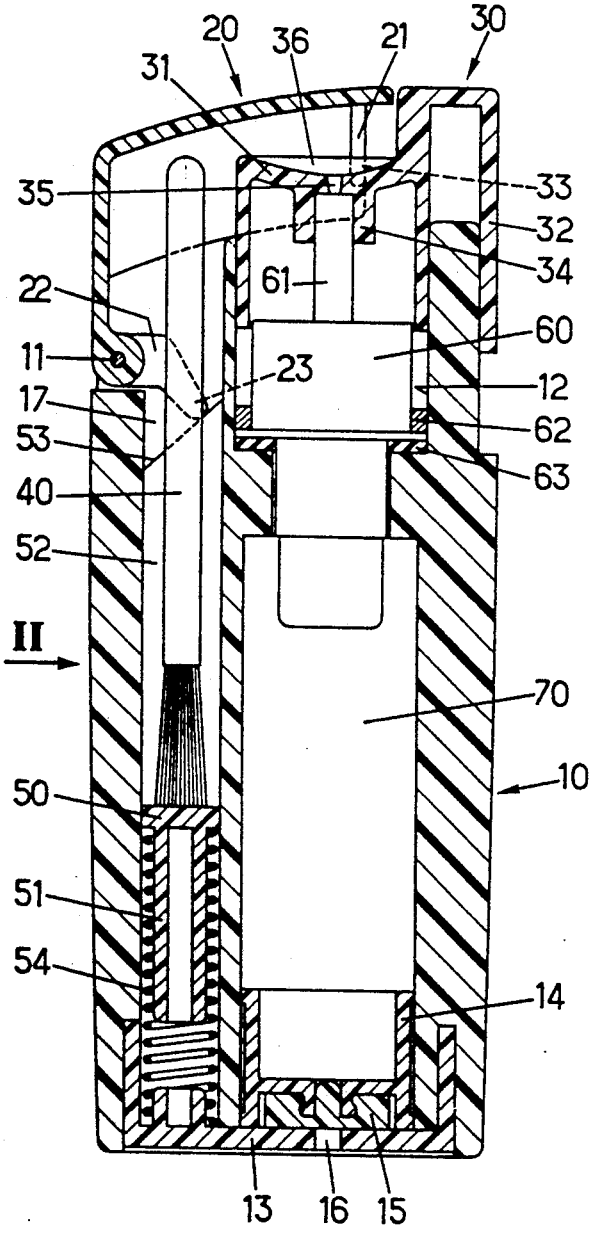
FIG. 1 shows the complete apparatus in section along I of FIG. 2.

As can be seen in FIG. 1, the apparatus comprises a body 10 of substantially oval cross-section, a cap 20, a push-button 30, a brush 40, an elevator 50, a pump 60 and a product reservoir 70.

The cap 20 is rotatably linked to the body 10 by means of a pin 11.

Figure 2:
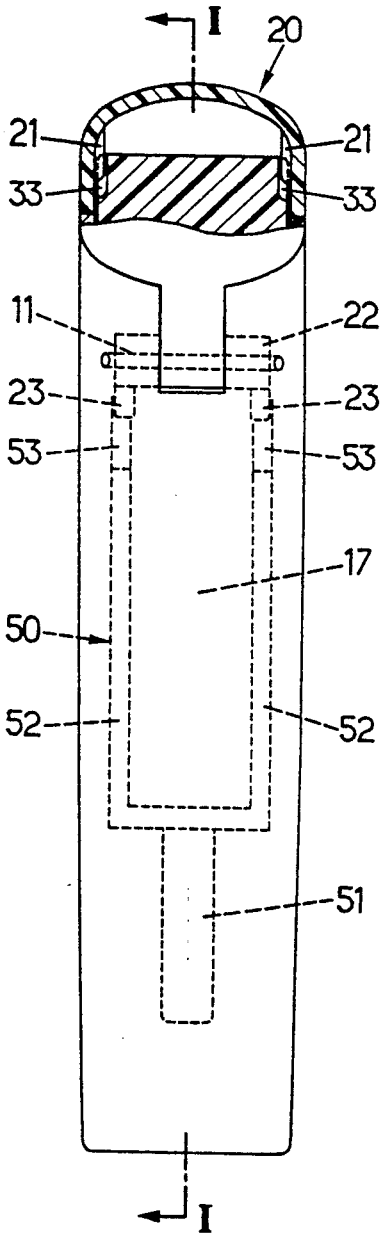
FIG. 2 is a view in the direction of II of FIG. 1, partially cut away in the region of the cap.

The push-button 30 comprises a central part 31, slidably mounted in a cylindrical bore 12 of the body 10. This push-button 30 comprises an additional outer part 32 which partially covers the body 10. In this FIG. 1, the push-button is shown in the raised position and, in this position, it keeps the cap closed by means of two inner projections 21 of the cap, each engaged in a groove 33 of this push-button, as shown by the cutaway of FIG. 2.

The central part 31 of the push-button 30 comprises a shoulder 34, an orifice 35 and a dish 36. The shoulder 34 receives a rod 61 connected to the piston (not shown) of the pump 60. This rod has a central orifice (not shown) along which the product to be dispensed flows. This central orifice is located opposite the orifice 35, so that the product to be dispensed passes through the central orifice of the rod and the orifice 35 and spurts into the dish 36. The pump 60 is a standard airless pump mounted in the cylindrical bore 12 of the body 10 by means of a crimping ring 62. A seal 63 ensures the leak-tightness of the reservoir 70.

This reservoir 70 is closed at its lower end by a piston 14 equipped with an obturating seal 15. Thus, the product enclosed in the reservoir 70 is always protected from the air and it does not oxidise.

The body 10 is closed at its lower end by a closing plate 13 equipped with an orifice 16 which puts the piston 14 and its seal 15 in communication with the outside. Thus, when a measured quantity of product is delivered by the pump, its volume is immediately filled by the ascent of the piston 14 which is subject to atmospheric pressure.

The body 10 has a cavity 17 which extends over its entire height and which contains a brush 40. This brush 40 is placed on a plunger 50 which comprises a bottom part 51 constantly bearing against a spring 54, the other end of the spring bearing against the closing plate 13, and a top part consisting of two branches 52 each ending in an inclined ramp 53, as can be seen in FIG. 2. The brush is thus situated between the two branches of the plunger 50.

The cap comprises two cams 23, which can be seen likewise in FIG. 2, and each cam cooperates with an inclined ramp 53 of the plunger 50.

Figure 3:
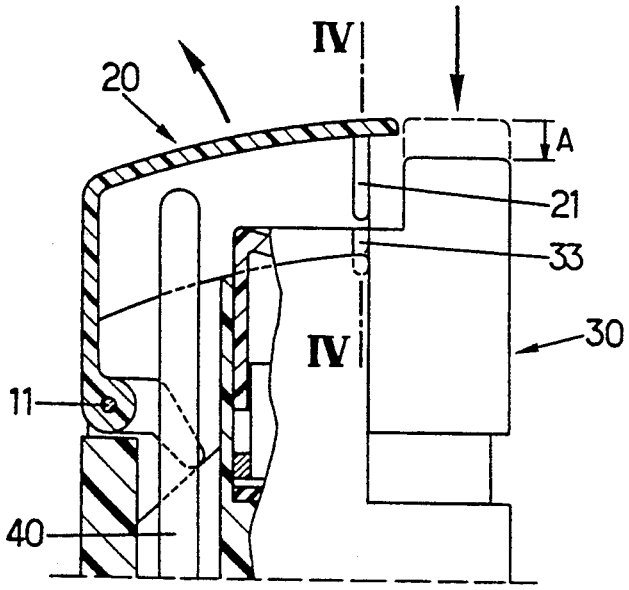
FIG. 3 is a partial view showing the opening of the cap after unlocking.
Figure 4:
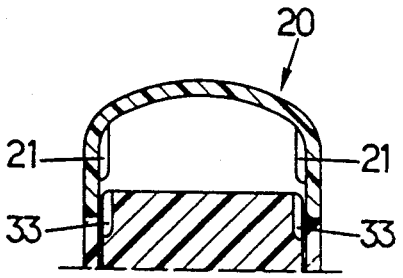
FIG. 4 is a cross-section along IV of FIG. 3.
Figure 5:
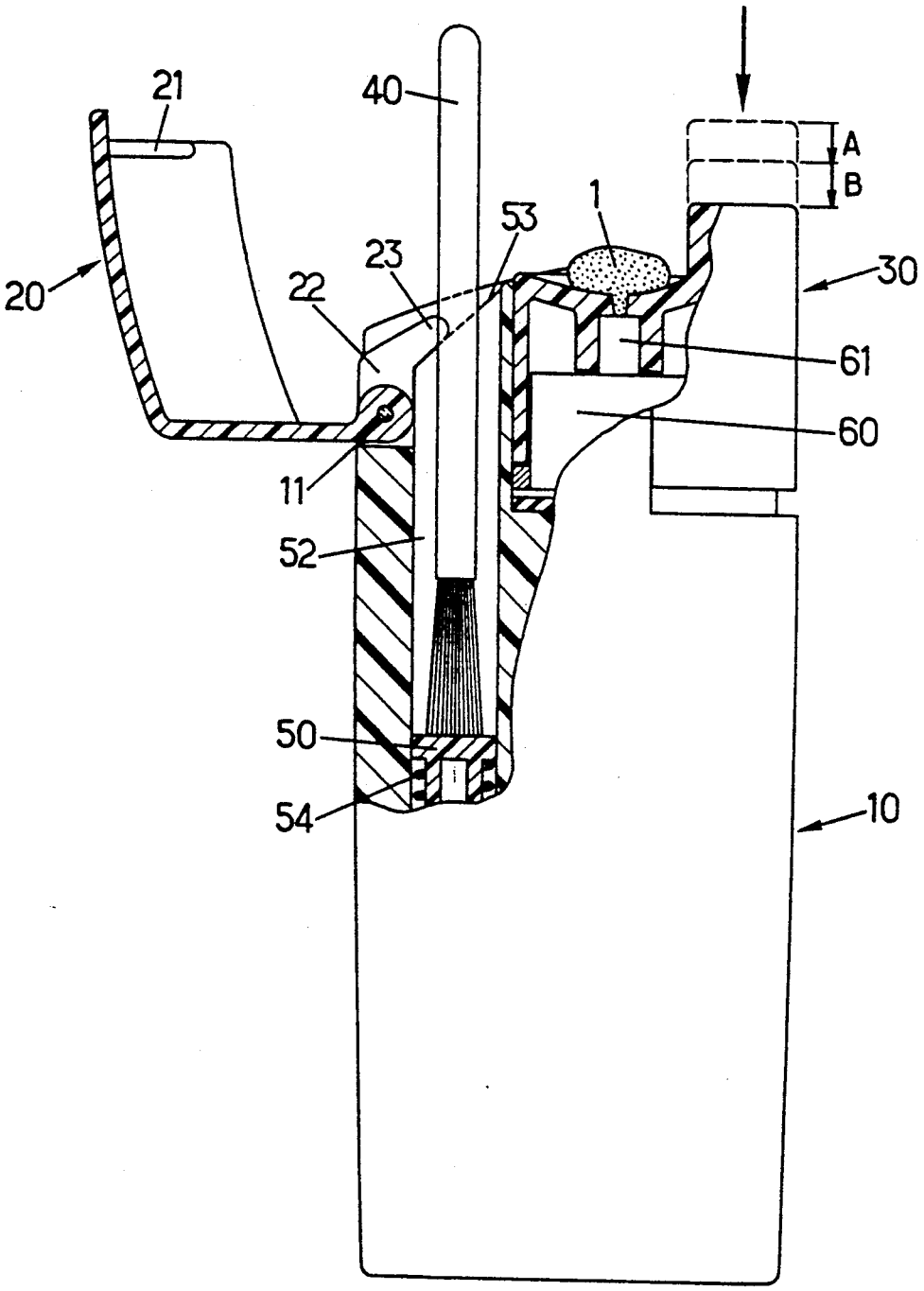
FIG. 5 is a view showing the completely open cap, the partially ejected brush and the dispensed product.

FIG. 3 shows the opening of the cap, which is obtained by pressure on the push-button and in accordance with a first stroke A. The projections 21 of the cap are released from the grooves 33 (FIG. 4) and the cap can then pivot since the spring 54, still in compression, pushes the plunger 50 and the inclined ramps 53 push the cams of the cap. The cap then rotates through approximately 90° and comes to bear against the body, as shown in FIG. 5.

The plunger is at maximum elevation, the ramps 53 bearing against the cams 23, and the brush is then partially ejected and made available to the user.

By continuing to press the push-button in accordance with a second stroke B, which is equivalent to actuating the pump in accordance with a stroke A+B, the pump delivers a small measured quantity of product into the dish 36. At this stage, the user releases the pushbutton, which rises again, and removes the brush, takes the measured quantity of product, applies it and replaces the brush in the cavity 17, bearing against the plunger 50.

Figure 6:
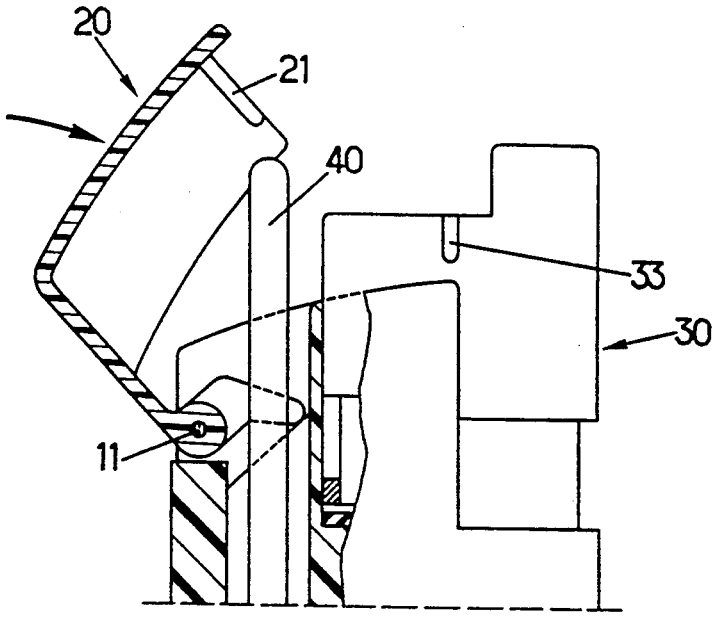
FIG. 6 is a a partial view showing the closure of the cap.

FIG. 6 shows the closure of the apparatus. After replacing the brush in the cavity 17, the user flips the cap 20 over. The brush is retracted before the cap passes and, when this cap is virtually in its closed position, the projections 21 snap into the grooves 33 of the push-button by elastic deformation of the cap but also by a slight descent of the push-button, which will return to its upper position when the snap-in procedure is complete.

Such an apparatus is used in accordance with the following steps:

pressing on the push-button in accordance with the stroke A to unlock the cap, flip the cap over and raise the brush, pressing on the push-button in accordance with the stroke B (or in accordance with the stroke A+B if the push-button has been released after the unlocking of the cap) to fill the dish, taking the brush, taking the measured quantity of product with the brush (where appropriate, new stroke A+B if the user desires another measured quantity), replacing the brush, closing of the cap by flipping it over until it snaps onto the push-button.

I claim:

1. Apparatus for dispensing products such as cosmetics products to be applied by means of a brush, comprising a body containing a sealed reservoir containing a product to be dispensed, a cap pivotable on said body between a closed position and an open position, a pump for pumping the product from said reservoir, a control button for said pump, a plunger reciprocally movable between a lower position and an upper position, a spring biasing said plunger toward said upper position, and an applicator brush supported by said plunger so as to be partially ejected from the apparatus in said upper position of said plunger under action of said spring, said control button being a push-button performing a push stroke to actuate said pump, said push-button and said cap including first means for locking said cap in said closed position by said push-button, for unlocking said cap at a beginning of the push stroke of the push-button and for actuating the pump during a continuation of the push stroke of the push-button, and said cap and said plunger including second means for causing the cap, after unlocking, to pivot toward said open position by said plunger under the action of the spring, and for causing the plunger to move toward the lower position thereof to retract the applicator brush when the cap is pivoted toward said closed position until locking thereof on the push-button.

2. Apparatus according to claim 1, wherein said first means comprise two inner projections formed on the cap and two outer grooves formed in the push-button, said projections cooperating with said grooves such that upon closure of the cap, the projections snap into the grooves.

3. Apparatus according to claim 1, wherein said second means comprise two portions provided on said plunger and each terminating in an inclined ramp, and two cams formed on said cap for cooperating with inclined ramps of said portions of said plunger.

4. Apparatus according to claim 1, wherein said push-button comprises a dish for receiving the product pumped by the pump.

5. Apparatus for dispensing a cosmetic product, comprising a body having two opposite ends, a sealed reservoir located in said body and containing the product to be dispensed, a piston pump positioned at a first end of said body for dispensing the product contained in the reservoir, said body having a cavity extending from said first end toward a second end of said body, a plunger slidable in said cavity, a spring biasing said plunger toward said first end of the body, a brush for applying the product dispensed by the pump, said brush being received in said cavity and being raised toward said first end of the body and partially ejected at said first end by the plunger under the action of the spring, a push-button positioned at said first end of the body, said push-button being actuable to produce a push stroke for operating the pump, and a cap pivotably mounted on the body at said first end thereof so as to pivot between two positions for covering said first end of the body in a closed position and uncovering said first end of the body in an open position, respectivley, said push-button and said cap comprising first means for locking the cap in the closed position thereof onto the push-button in a raised position of the push-button and for unlocking the cap after a first portion of the push stroke of the push-button, and said cap and said plunger comprising second means for pivoting the cap, after unlocking thereof, from said closed position to said open position by a raising movement of the plunger under the action of the spring, and for lowering the plunger against the action of the spring by a pivoting movement of the cap from said open position to said closed position.

6. Apparatus according to claim 5, wherein said first means comprise two inner projections formed on the cap and two outer grooves formed in the push-button, said projections cooperating with said grooves such that upon closure of the cap, the projections snap into the grooves.

7. Apparatus according to claim 5, wherein said second means comprise two portions provided on said plunger and each terminating in an inclined ramp, and two cams formed on said cap for cooperating with inclined ramps of said portions of said plunger.

8. Apparatus according to claim 5, wherein said push-button comprises a dish for receiving the product dispensed by the pump.

* * * * *